United States Patent [19]

Deken

[11] 4,143,432

[45] Mar. 13, 1979

[54] ADJUSTABLE DRAIN PLUG

[76] Inventor: Frederick J. Deken, 19 Ruskin Rd., Glen Iris, Victoria, Australia, 3146

[21] Appl. No.: 800,226

[22] Filed: May 25, 1977

[30] Foreign Application Priority Data

May 21, 1976 [AU] Australia ..... 6026/76

[51] Int. Cl.[2] ..... A47K 1/14; E03C 1/23

[52] U.S. Cl. ..... 4/295; 220/301; 251/100

[58] Field of Search ..... 4/286–289, 4/295, 290–293; 220/300, 301, 303, 60, 307; 222/549, 552, 554; 251/100, 251, 252; 138/89

[56] References Cited

U.S. PATENT DOCUMENTS

| | | | |
|---|---|---|---|
| 772,434 | 10/1904 | Schultz | 4/295 |
| 1,224,712 | 5/1917 | Clark | 4/292 |
| 1,613,251 | 1/1927 | Stead | 4/295 |
| 1,988,383 | 1/1935 | Hermani | 220/301 |
| 2,169,896 | 8/1939 | Gazey | 4/287 X |
| 2,915,762 | 12/1959 | Kivela | 4/295 |
| 3,913,783 | 10/1975 | Cooper | 220/301 X |
| 4,032,036 | 6/1977 | Sycle, Jr. | 220/301 X |

*Primary Examiner*—Stuart S. Levy

*Attorney, Agent, or Firm*—Andrus, Sceales, Starke & Sawall

[57] ABSTRACT

The present invention provides a plug comprising a body having a sealing means arranged to sealingly engage with a portion of a vessel surrounding a drain outlet and a regulating means mounted on the body and arranged upon partial rotation to open or close the plug to permit or prevent respectively, egress of liquid from the vessel.

7 Claims, 8 Drawing Figures

FIG.

ADJUSTABLE DRAIN PLUG

FIELD OF THE INVENTION

BACKGROUND OF THE INVENTION

The present invention relates to a plug. The plug of the present invention is particularly useful for closing the drain outlet of vessels arranged to contain liquid such as baths, sinks and tanks.

SUMMARY OF THE INVENTION

In accordance with one aspect of the present invention there is provided a plug comprising a body having a sealing means arranged to sealingly engage with a portion of a vessel surrounding a drain outlet and a regulating means mounted on the body and arranged upon partial rotation to open or close the plug to permit or prevent respectively, egress of liquid from the vessel.

A plug constructed in accordance with the present invention enables liquid to be drained from a vessel without removing the plug as a whole and without breaking the seal between the plug and the vessel.

PREFERRED ASPECTS OF THE INVENTION

It is preferred that said body includes a generally cylindrical sleeve receivable in said outlet and a peripheral flange extending generally perpendicular to said sleeve.

In one instance said flange has a surface adapted to sealingly engage with said portion.

In another instance said flange carries a resilient annulus adapted to sealingly engage with said portion.

It is preferred that one end of said sleeve defines a seat for said regulating means when in the open position.

It is preferred that one of said body and said regulating means has a cam surface and the other has a cam follower and constructed and arranged such that interengagement of said cam surface and said follower during said partial rotation moves said regulating means out of engagement with the seat.

It is preferred that said cam surface has a portion at one end defining a stable position for the follower with said regulating means in the open position and intermediate said one end and the other end the cam surface is such that an unstable conditions exists from which said regulating means will tend to revert to the closed position.

It is preferred that said regulating means is releasably connected to said body and wherein such release can only be obtained intermediate said one end and said other end.

It is preferred that there is stop means defining the limits of said partial rotation.

The present invention will now be described further, by way of example, with reference to the accompanying drawings.

BRIEF DESCRIPTION OF THE VIEW OF THE DRAWINGS

DETAILED DESCRIPTION

Figure 1:
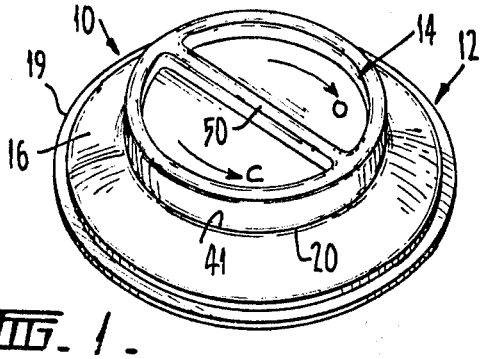
FIG. 1 is a top perspective view of the plug.

In the drawings, there is shown a plug 10 in accordance with the present invention comprising a body 12 and a regulating portion 14.

The body 12 comprises a ring or flange member 16 and a circular depending wall 18 integrally formed with one another. The body 12 is typically formed of plastics material.

If the body 12 is formed of a relatively hard plastics material a circular sealing pad 19 formed of softer plastics material or other suitable material is preferably provided around the periphery of the ring member 16. However, if the body 12 is formed of a relatively soft plastics material, the sealing pad 19 may be dispensed with the adequate sealing will be obtained by the ring member 16.

The edge 20 between the ring member 16 and the inside surface of the depending wall 18 is preferably curved for reasons which will be explained hereinafter.

Figure 4:
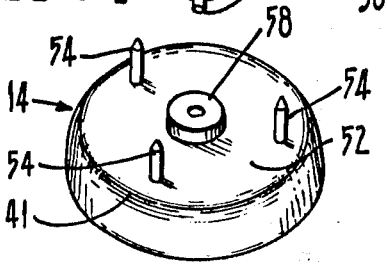
FIG. 4 is a cross-sectional view of the plug.
Figure 4:
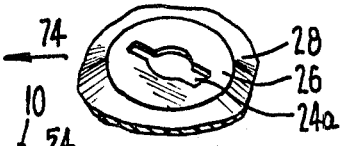
Figure 4:
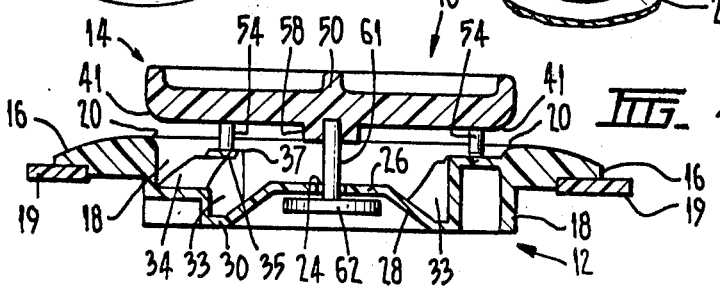

The floor formed across the lower end of depending wall 18 comprises a circular aperture 24 surrounded in succession by a circular raised portion 26 and a circular downwardly (as seen in FIG. 4) sloped portion 28.

The sloped portion 28 is integrally formed with three part circular, equi-spaced base members 30. Each base member 30 is on its outer margin integrally formed with a cam member having a substantially vertical inner wall 33 and an inclined ramp surface 34 (see FIGS. 5 and 6). The outer margin of each ramp surface 34 is connected to the inner surface of the depending wall 18.

Figure 2:
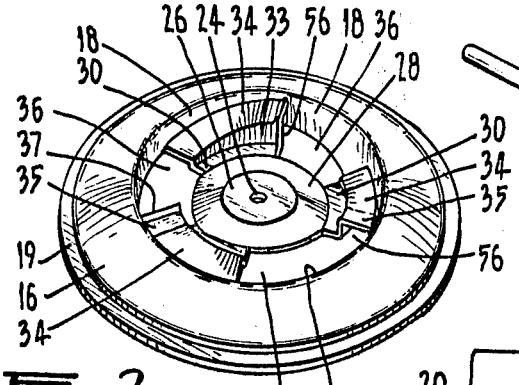
FIG. 2 is a top perspective view of part of the plug.

Between each pair of adjacent cam members and their associated base member 30 there is a drain aperture 36 (see FIG. 2).

The cam members are all of the same shape and upon clockwise rotation about the body 12 as seen in FIG. 2, each cam member slopes upwardly away from one of the drain apertures 36 and terminates against the next drain aperture 36.

Figure 5:
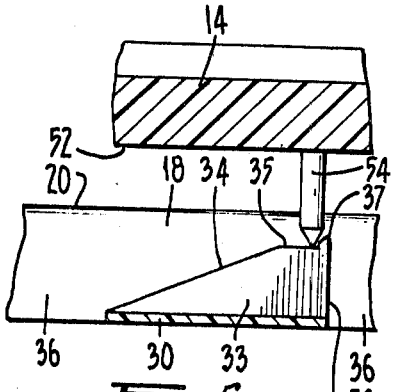
FIG. 5 is a developed cross-sectional view of part of the plug and shows elements in one orientation.
Figure 6:
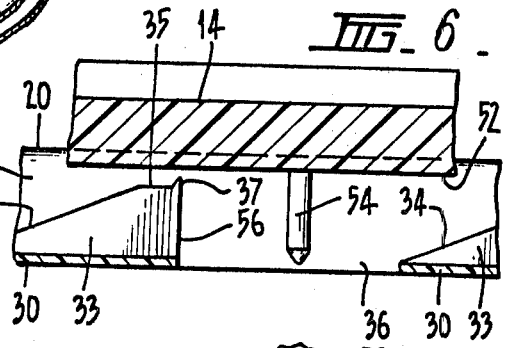
FIG. 6 is a developed cross-sectional view of part of the plug and shows elements in another orientation.
Figure 3:
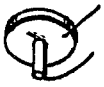
FIG. 3 is a bottom perspective view of another part of the plug.

The slope of the cam members is best seen in FIGS. 5 and 6 and it is to be noted that the inclined ramp surfaces 34 merge with horizontal portions 35 and a terminal stop 37 is provided.

The regulating portion 14 comprises a circular cap member. The circular surface is preferably undercut at 41.

The cap member has a rib 50.

On its lower surface the regulating portion 14 is provided about its periphery with three equi-spaced pegs 54. Each peg 54 is provided with a tapered free end which is inclined to the lower surface 52. Further, the lower surface is provided with a recessed central projection 58.

The body 12 and the regulating portion 14 are assembled together by placing the regulating portion 14 over the body 12 with the pegs 54 lowermost. The pegs 54 are each placed in a respective drain aperture 36, with the inclined free ends substantially parallel to the adjacent ramp surface 34 in the clockwise direction.

Then a post having a shank 61 and a flange 62 at one end is inserted upwardly shank 61 foremost through the central circular aperture 24 of the sealing member 12 until the shank 61 is pressed into the recessed central projection 58 of the regulating member 14.

In operation, the regulating member 14 is partially rotated by means of the rib 50 in a clockwise direction so that the pegs 54 mount respective adjacent ramp surfaces 34. This causes the regulating member 14 to be simultaneously raised. Rotation of the regulating member 14 is restricted either by the flange 62 of the post 60 being caused to bear against the underside of the raised portion 26 as shown in FIG. 4 or by the terminal stops 37 and, as necessary, by the ends 56 of the cam members.

When the plug 10 is placed in a drain outlet of a vessel a seal is formed in known manner between the sealing pad 19 and the portion of the floor of the vessel surrounding the drain outlet as soon as liquid enters the vessel. This prevents any leakage of liquid around the periphery of the plug 10.

Similarly, the weight of the liquid acts on the regulating member 14 when it is in the closed position (i.e. pegs 54 in respective apertures 36) to form a seal between the undercut portion 41 of the cap member and the curved edge 20 of the body 12. This prevents leakage of liquid around the periphery of the cap member. The edge 20 need not be curved but it has been found that a curved edge provides a more satisfactory seal.

When it is desired to drain liquid from the vessel, the regulating member 14 is simply partially rotated in a clockwise direction (see FIG. 2) by means of the rib 50 so that the pegs 54 ride up the ramp surfaces 34 on to the horizontal portions 35. This breaks the seal between the undercut portion 41 and the edge 20 and allows egress of liquid through the drain apertures 36. When a desired amount of liquid has been drained the regulating member 14 is rotated back to the closed position and further egress of liquid is prevented.

It is to be noted that the co-efficient of friction of the ramp surfaces 34 and pegs 54 are desirably such, and the slope of the ramp surfaces 34 are desirably such, that the regulating portion 14 is only stable when the pegs 54 are located in the drain apertures 36 or on the horizontal portions 35 and that when the pegs are on the ramp surfaces 34 per se the regulating portion 19 will be unstable such that in use, spontaneously rotate under its own weight, perhaps with assistance of a head of water bearing thereon, to the closed position wherein the pegs 54 are located in the drain apertures 36.

Figure 7:
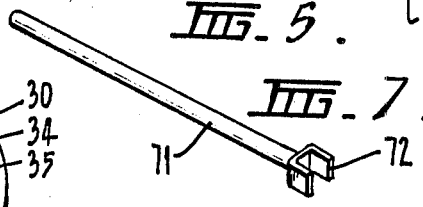
FIG. 7 is a perspective view of a device which can be used with the plug.

In a modification of the above, a tool is provided as shown in FIG. 7. That tool includes a shank 71 and an end 72 capable of engaging with the rib 50 to rotate the regulating portion 14 relative to the body 12.

Figure 8:
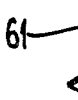
FIG. 8 is a fragmentary perspective view of a modified plug.

In another modification shown in FIG. 8, the shank 61 is integrally formed with the regulating portion 14 and has a key head 73. Further, the circular raised portion 36 has an aperture **24*a* of shape corresponding to that of the key head 73**.

As a result of the aperture **24*a* and key head 73 the regulating portion 14** may be detached from the body for purposes such as cleaning.

Further, it is desirable that the arrow 74 on FIG. 8 should be directed towards one of the ramp surfaces 34 and not towards one of the drain apertures 36 or horizontal portions 35. This will mean that a positive act of manual orientation to an unstable position will need to be performed before the regulating portion 14 can be detached from the body portion 12. Thus, accidental removal, as could more easily happen if the arrow 74 was directed towards one of the drain apertures 36 or horizontal portions 35 is unlikely.

The plug 10 of the present invention has the advantage that it is not necessary to break the seal between the plug and the vessel to allow some liquid to be drained. Also, the regulating member 14 may be rotated by the use of an implement. This is particularly useful if the vessel contains a corrosive or hot liquid as an operator need not come in contact with the liquid.

The claims form part of the disclosure of this specification.

Modifications and adaptations may be made to the above described without departing from the spirit and scope of this invention which includes every novel feature and combination of features disclosed herein.

In a modification the flange member 16 and pad 19 are omitted to make the wall 18 receivable within a plug hole.

I claim:

1. A plug for a drain outlet of a vessel, said plug comprising:

a generally tubular body formed for removable insertion in said outlet, said body having sealing means on the exterior adapted to engage at least one of said drain or vessel to provide a water-tight seal therewith, said body having a drain passage through the central interior thereof;

a closure member for said tubular body located on the upper end of said tubular body and axially movable with respect thereto between a lower position in which said closure member abuts said tubular member for sealing said central passage and an upper position in which said closure member is axially spaced from said tubular member for discharging the contents of said vessel through said central passage; and ramp means mounted on the interior of said tubular body along the central passage, said ramp means having a plurality of upwardly facing ramping surfaces, means interconnecting said ramping surfaces to form a guide for said closure member and to form drain passages for permitting fluid flow between said ramping surfaces when said closure member is moved to its upper position, depending from the closure member and ramp follower means lower surface for contacting said ramping surfaces to provide axial movement to said closure member upon rotating of said closure member from a first rotary position to a second, angularly displaced, rotary position; said ramping surfaces including portions retaining said closure member in the upper position.

2. A plug as claimed in claim 1 wherein the angle of said ramping surfaces is such that the contact with the follower means tends to cause the naturally occuring forces applied to the closure member to bias said closure member toward the closed position.

3. The plug as claimed in claim 1 wherein said ramp means includes means for limiting the rotation of said closure member, said limited rotation including said first and second positions.

4. A plug as claimed in claim 1 wherein said sealing means comprises a peripheral flange extending generally perpendicular to said tubular body for sealing engaging with at least one of said drain or vessel.

5. A plug as claimed in claim 4 wherein said flange carries a resilient annulus adapted to sealingly engage with one of said drain or vessel.

6. A plug as claimed in claim 1 wherein said closure member is coupled to said tubular body.

7. A plug as claimed in claim 6 including means coupling said closure member to said tubular body and permitting separation of said closure member from said tubular body at a rotary position other than said first or second positions.

* * * * *

UNITED STATES PATENT AND TRADEMARK OFFICE

CERTIFICATE OF CORRECTION

PATENT NO. : 4,143,432

DATED : March 13, 1979

INVENTOR(S) : FREDERICK J. DEKEN ET AL

It is certified that error appears in the above-identified patent and that said Letters Patent are hereby corrected as shown below:

| | | |
|---|---|---|
| Column 2, | Line 22, | After "with" cancel "the" and substitute therefor ---and--- |
| Column 4, | Line 37, | Cancel "depending" |
| Column 4, | Line 38, | Cancel "from the closure member" and after "means" insert ---depending from the closure member--- |
| Column 4, | Line 41, | Cancel "rotating" and substitute therefor ---rotation--- |
| Column 4, | Line 56, | Cancel "sealing" and substitute therefor ---sealingly--- |
| In the Heading, | | Cancel Item [30] Foreign Application Priority Data |

Signed and Sealed this

*Seventh* Day of *August 1979*

[SEAL]

*Attest:*

*Attesting Officer*

LUTRELLE F. PARKER

*Acting Commissioner of Patents and Trademarks*